United States Patent [19]

Williams

[11] Patent Number: 4,997,664

[45] Date of Patent: Mar. 5, 1991

[54] METHOD FOR PACKAGING FOOD PRODUCTS

[75] Inventor: Roger S. Williams, Calhoun, Ga.

[73] Assignee: Bryan Foods, Inc., West Point, Miss.

[21] Appl. No.: 403,131

[22] Filed: Sep. 5, 1989

[51] Int. Cl.[5] ..... B65G 55/00

[52] U.S. Cl. ..... 426/392; 53/432; 426/316; 426/396

[58] Field of Search ..... 426/392, 396, 418, 316, 426/106, 397; 53/432, 433, 434, 514, 512, 513

[56] References Cited

U.S. PATENT DOCUMENTS

| | | | |
|---|---|---|---|
| 2,813,799 | 11/1957 | Bender et al. | 426/392 |
| 3,481,100 | 12/1969 | Bergstrom | 426/392 |
| 3,987,209 | 10/1976 | Gatineau et al. | 426/396 |
| 4,294,859 | 10/1981 | Lundquist et al. | 426/410 |

*Primary Examiner*—Donald E. Czaja
*Assistant Examiner*—Tony Weier
*Attorney, Agent, or Firm*—Alan Ruderman

[57] ABSTRACT

A method and apparatus for packaging food products provides evacuation of air and application of purging gas in two stages. The first stage evacuates air and applies an initial gas flush to a first group of packages while the second stage provides an evacuation of a portion of the gas initially applied and applies a second gas flush to the group and then seals the packages. The packages include food containing bases which enter the first stage station of the apparatus where lidding material is laid over a small leading portion of the group, and as this group is transported to the second stage station the lidding material is fed onto the remainder of the bases of the group. Each station includes an evacuation chamber having a base receiving cavity, the second station including base receiving dies acting in conjunction with a heater for bonding the lidding material to the bases. The cavity is closed after two groups of bases have been indexed into the cavity. After the evacuation and gas flush the dies are moved upwardly to force the group in the second station against the heater to bond the lidding material to the base. The cavity is thereafter opened so that the group of bases in the second stage may be removed and the group in the first stage may be indexed to the second stage while a third group is indexed into the first stage.

10 Claims, 3 Drawing Sheets

METHOD FOR PACKAGING FOOD PRODUCTS

BACKGROUND OF THE INVENTION

This invention relates to the packaging of food products, and more particularly to a method and apparatus for forming hermetically sealed packages which have been purged of air by multiple flushing of the packages with inert gas to retain the food products in a fresh state.

It is known in the art of packaging processed food to evacuate air from the packages by the application of subatmospheric pressure commonly called drawing a vacuum, and thereafter hermetically sealing the packages to retain the original freshness of the product. Since a perfect vacuum is substantially impossible to attain within the earth's atmosphere, and since low subatmospheric pressures are difficult and costly to attain, it is common, when packaging certain food products, to flush the packages with relatively inert gas which substantially displaces the air. This flushing may be used together with or in lieu of the evacuation step. However, unless a substantial amount of gas is utilized, a certain amount of air, which contains various food spoiling impurities, remains in the packages resulting in a shortened shelf life. In order to increase the amount of purging gas supplied to the packages and thereby flush more air from the packages utilizing prior art methods and apparatus would require that the processing time be substantially increased, thereby increasing the packaging cost. The disadvantage of increased cost appears not to be justified by the increased shelf life of the product's package. Consequently, a single application of gas to flush the packages is the manner in which the prior art has developed.

In the formation of the packages, a thermoplastic material is heated and formed by dyes at a forming station to form a base having one or more food containing cavities. The base is moved to a food dispensing station and the food is placed into the cavities. It then moves to a station wherein a covering of lidding material is laid over the base. The evacuation and/or flushing thereafter is performed and the lidding material and base are pressed together and sealed. There are generally two methods for applying the flushing gas to the packages. One of the method applies the gas through a series of hollow pins disposed in a slit made in the forming material or the lidding material, the pins being intermediate the sealing heater and thus the later sealed portions of the materials and small clips outside of the seal area which hold the materials together while the gas is applied. Since the pins must of necessity be of a relatively small diameter, a small area is presented through which the gas flows and thus the gasing time is relatively long. Additionally, the slit has to be sealed. An improvement to this method is the use of a nozzle system whereby the gas is applied through one or more nozzles and directed between the forming material and the lidding material outside of the subsequently sealed area. Although this method provides a faster flush because of the larger area through which the gas may flow, the available area is still relatively small so that the gasing time is still relatively large.

SUMMARY OF THE INVENTION

Consequently, it is a primary object of the present invention to provide a method and apparatus for multiple gas flushing of food containing packages prior to the final sealing thereof to maintain the food in a fresh state without increasing the processing time.

It is another object of the present invention to provide a method and apparatus for evacuating air from food packages and flushing said packages with gas prior to hermetically sealing the packages to maintain the state of freshness of the food, such method and apparatus resulting in a purer gas with less impurities remaining in the packages without an increase in the processing time required.

It is a further object of the present invention to provide a method and apparatus for increasing the area through which purging gas may be applied during the process of forming sealed food packages, such increase in area resulting in less processing time for forming the packages.

It is a still further object of the present invention to provide a method and apparatus for evacuating air and applying a purging gas flush to food packages in two stages prior to sealing the packages resulting in a reduction in processing time to obtain an equal removal of impurities or a greater removal of impurities without an increase in processing time relative to the prior art, such method and apparatus additionally providing an improved distribution of gas within the packages processed during each processing cycle.

Accordingly, the present invention provides a method and apparatus for packaging food products while retaining the food in a fresh state for a substantial period of time, the method and apparatus providing evacuation of air and application of purging gas in two stages, the first stage providing evacuation of air and an initial application of a gas flush to a group of packages, and the second stage providing an evacuation of at least a portion of the gas initially applied and the application of a second gas flush to the group of packages, the first and second stages occurring at different stations between which the group of packages are cyclically indexed. While one group of packages connected to the first group is indexed from the first stage to the second stage, another group of packages is indexed to the first stage. By maintaining the cycle time at each stage substantially equal to the cycle time required in the prior art to perform a single flush of gas, a purer environment is provided for the sealed food product without an increase in cycle time, or alternatively stated, the cycle time is substantially reduced relative to available prior art double flushing methods and apparatus.

During the process a first group of food filled package bases enters the first stage station where lidding material is laid over a small leading edge portion of the group prior to the air evacuation and first gas flush, the lidding material being fed through an air/gas lock which is cyclically opened to permit feeding of the lidding material and thereafter closed during the air evacuation and gas application steps. Each time the apparatus indexes a group of packages to the next stage, the air lock opens and the lidding material is fed onto the package bases. As the first group is indexed to the second stage, the lidding material is laid onto the remaining portion of the first group and the leading edge portion of the next group. After the second application of gas to the first group of packages, the lidding material and the bases are sealed together at the second stage.

Since the major portion of the first group of packages is not covered by lidding material, the area for evacuation of air and the application of gas is substantial. Additionally, the bases of each group of packages comprises grooves about the periphery of the individual packages recessed relative to the upper surface of the bases, such recesses providing space for the gases to flow from the group being evacuated and supplied with gas at the second stage and the leading edge portion of the group at the first stage. Thus, the area presented for the flow of gas is substantially greater than that presented by the prior art pin or nozzle systems and the speed of gas flushing may be increased, while the air lock arrangement at the first stage minimizes gas leakage. Additionally, because of the combination of these various factors, a more even distribution of gas throughout the group of packages during each index or cycle results than that provided by the prior art.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
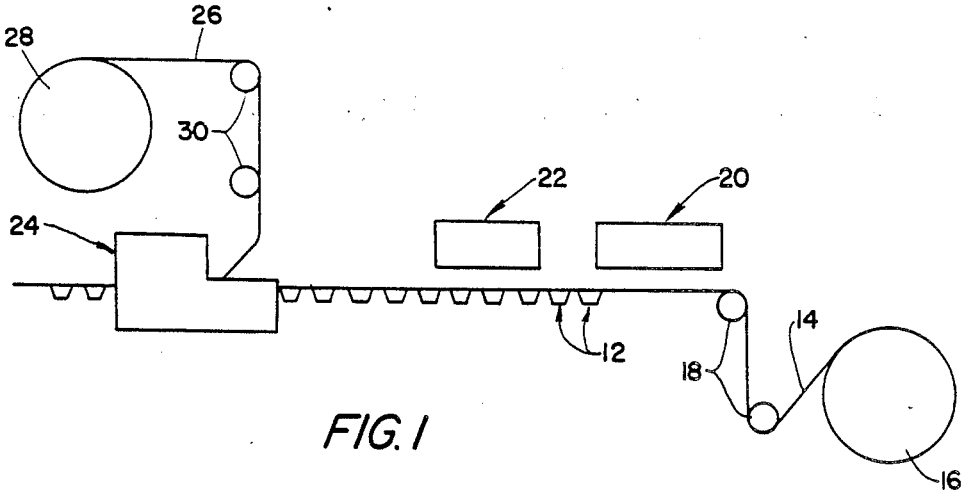
FIG. 1 is a schematic view of a portion of a food product packaging system incorporating the method and apparatus of the present invention.

Referring now to the drawings, FIG. 1 illustrates an overview of the process for forming food product containing packages including the method and apparatus of the present invention. Accordingly, the bases 12 of the packages to be formed is constructed from thermoplastic material 14 paid out from a roll 16 about a number of guide and/or feed rollers generally indicated at 18 and fed to a forming station 20 of the machine wherein the stock is heated and formed into the desired shape of the bases or bottoms of the packages by conventional means including the drawing of a vacuum and the application of compressed air to form the stock in conjunction with one or more forming dies. The forming material may comprise a sheet of material preformed in a sandwich construction from nylon, Saran brand colpolymer of polyvinylidene chloride, and Surlyn brand ionomer. The formed bases 12 connected together in groups are thereafter fed by conveyer during each index of the machine to the product inserting station 22 where the food product is inserted. The product carrying bases are thereafter transported to the covering and sealing station 24 incorporating the apparatus of the present invention. At this station the covering stock or lidding material 26 is paid out from a roll 28 and fed about a number of guide and/or feed rollers generally indicated at 30 where it enters the apparatus 24 as hereinafter described. The lidding material is conventional and may be Saran brand copolymer of polyvinylidene chloride, Surlyn brand ionomer and a polyester material formed in sandwich fashion.

The covering and sealing station 24 of the present invention comprises a die housing or chamber 32 having a cavity 122 into which a group of bases 12 is fed during each index of the machine, the chamber 32 being secured to a manifold plate 34 in the bed 33 of the machine by a plurality of bolts 35. The chamber 32 and the manifold plate have one or more aligned bores 38 extending therethrough for applying a vacuum to and for venting air from the chamber and thus the lower surface of the bases as hereinafter described.

Figure 2:
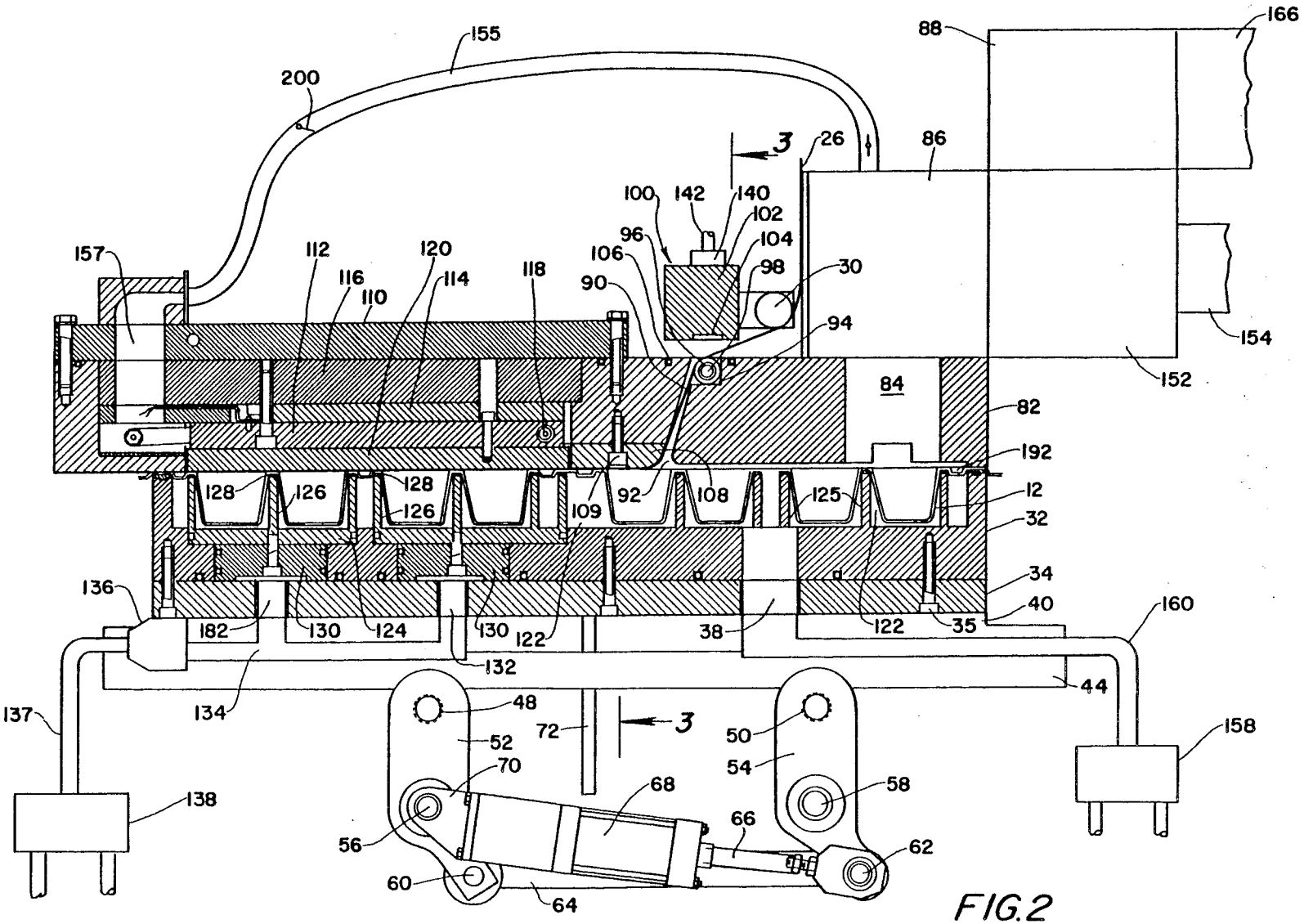
FIG. 2 is a longitudinal cross sectional section taken through apparatus constructed in accordance with the principles of the present invention.
Figure 3:
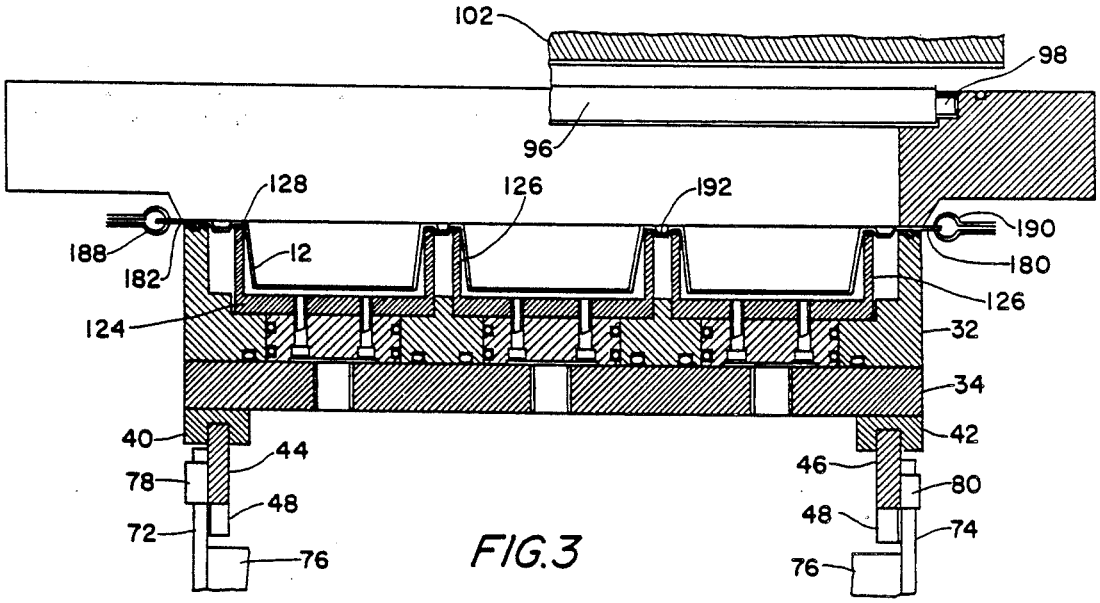
FIG. 3 is a fragmentary transverse cross sectional view taken substantially along line 3—3 of FIG. 2.

As best illustrated in FIGS. 2 and 3, the manifold plate 32 is fastened at its side to a respective elongated block 40, 42, each block 40, 42 having an elongated groove or channel for receiving a respective rail 44, 46. A pair of rollers 48, 50 supports each rail, the rollers at each side of the machine being pivotably carried on a respective lever 52, 54 forming a portion of a toggle mechanism. Each lever 52, 54, which is pivotably mounted on a respective journal pin 56, 58, spaced from the rollers 48, 50, has another pivot pin 60, 62 spaced from the journals 56, 58 remote from the rollers. A link 64 is pivotably connected to the pivot pins 60, 62 while the free end of the piston rod 66 of an pneumatic cylinder 68 also is connected to the pin 62. The free end of the cylinder has a clevis 70 pivotably mounted on the journal pin 56 of the lever 52 and when the piston rods are retracted, the levers 52 and 54 at each side of the machine rotate counter-clockwise as viewed in FIG. 2 to raise the rollers 48, 50 and thus the rails 44, 46 which in turn raises the manifold plate 34, and the evacuation chamber 32. When the piston rods are retracted, the levers 52, 54 rotate clockwise as viewed in FIG. 2 thereby to lower the manifold plate and the evacuation chamber. Keys in the form of respective rods 72, 74 are fastened to a frame member 76 at each side in the bed of the machine, the keys being received within respective key-ways 78, 80 to guide the movement of the rails 44, 46 so that the rails move vertically without any longitudinal movement. Other rollers (not illustrated) journalled within the guide blocks 40, 42 may be received within locator slots in the rails to ensure that the guide blocks and thus the manifold plate and evacuation chamber also move only in a vertical direction.

Disposed above the chamber 32 is a fixed heater mounting plate 82 which includes a port 84 extending therethrough for selectively communicating the evacuation chamber 32 and thus the upper surface and interior of the bases 12 with first and second solenoid valves 86, 88 fastened on the top surface of the heater mounting plate. A narrow lidding material receiving passageway 90 is formed through the mounting plate 40 extending angularly from an opening 92 at the bottom surface into the interior of the evacuation chamber at a location slightly upstream of the leading edge of the first packages of a group of packages that have entered the evacuation chamber, and opening at the top in a small channel 94. The lateral sides of passageway 90 are spaced from the lateral sides of the mounting plate 82 so that the channel 94 is closed at its transverse ends and a guide roller 96 is rotatably carried by a roller shaft 98 supported at its ends in the mounting plate 82 is disposed in the channel. As described herein, the lidding material 26 is cyclically fed about the roller 96 and the channel 94 is cyclically sealed against leakage when the feeding stops by an air lock indicated generally at 100 and to which further reference will be made. The air lock includes a bar 102 having a recess 104 for receiving the upper portion of the roller 96 when the bar is seated on the upper surface of the plate 82 and the channel 94 may be sealed by gaskets 106 disposed about the periphery of the channel 94 for this purpose.

A film shoe 108 is positioned in a recess formed in the bottom of the heater mounting plate 82 and secured thereto by bolts 109, the lower surface of the shoe being disposed slightly below the bottom of the heater mounting plate and includes a rounded corner at the lower edge adjacent the passageway 90 for guiding the lidding material 26 into engagement with the upper surface of the bases 12 in the evacuation chamber 32. Secured to the upper surface of the heater mounting plate 82 is a support plate 110 through which cooling water is circulated, the plate 110 supporting a heater plate 112 with an insulator plate 114 and a spacer plate 116 sandwiched therebetween. The insulator plate 114 abuts the heater plate which carries at least one electrical heating element 118, only one of which is illustrated. Carried at the lower surface of the heater plate 112 is a sealing plate 120 which is heated by the heater plate and which cyclically bonds the lidding material to the upper surface of the bases 12 as hereinafter described.

The cavity 122 is sized to receive two groups of bases, the selvage edges of the two groups being clamped between the top of the evacuation chamber 32 and the bottom of the heater mounting plate. Disposed within a portion of the cavity 122 in the sealing section of the evacuation chamber 32 beneath the sealing plate 120 is a plurality of package receiving dies in the form of inserts 124 within which the bases of the packages are received and sealed. The cavity 122 is effectively a die housing and the inserts carry sealing dies. In the preferred embodiment there are six such dies, one corresponding to each package or base in a group of packages sealed during each cycle or index of the machine. When a first group of packages is disposed within the dies 124 a second group of packages is disposed in the remainder or entry section of the cavity 122, the entry section having a plurality of fixed ribs 125. The second group of packages is fed to the sealing section dies as the first group is fed from the dies during each index of the machine. Each die includes a plurality of upstanding ribs 126 having a sealing die 128 secured at the upper extremity thereof. The number of fixed ribs 125 in the entry section, and the number of ribs 126 and sealing dies for each die insert is determined by the configuration of each package, there being a pair for each laterally and longitudinally extending edge of each package, and which may be a continuous member configured to the peripheral shape of each package base. Additionally, in the preferred embodiment there is at least one further rib 125, 126 and sealing die 128 between longitudinally spaced food receiving cavities of each package. Also disposed in a cavity in the evacuation chamber beneath the inserts is a plurality of sealing pistons 130, there preferably being one piston for each insert in the preferred embodiment for reasons hereafter made clear The pistons 130 are retained intermediate the bottom surfaces of the respective insert and the adjacent face of the manifold plate 34, the top face of the respective piston 130 abutting the bottom surface of the respective die insert 124 while the bottom face of the piston normally abuts the upper face of the manifold 34. A port 132 corresponding to each piston extends through the manifold plate 34 and communicates through conduits 134 with the interior of a manifold 136 which receives pressurized air to drive the pistons upwardly so that the sealing dies 128 may be driven upwardly to apply a force against the sealing plate 120 with the top surfaces of the bases and lidding material 26 therebetween thereby to bond the lidding material to the bases by the action of the heat applied by the sealing plate. The pressurized air is applied through a 3-way valve 138 which ports the pressurized air to or pulls a vacuum in the chamber 136 through a conduit 137 and thus the bottom face of the piston 130 When pressurized air is applied, the pistons are driven upwardly toward the sealing plate, and when a vacuum is drawn the pistons are pulled downwardly against the manifold plate 34 to the rest position.

Figure 4:
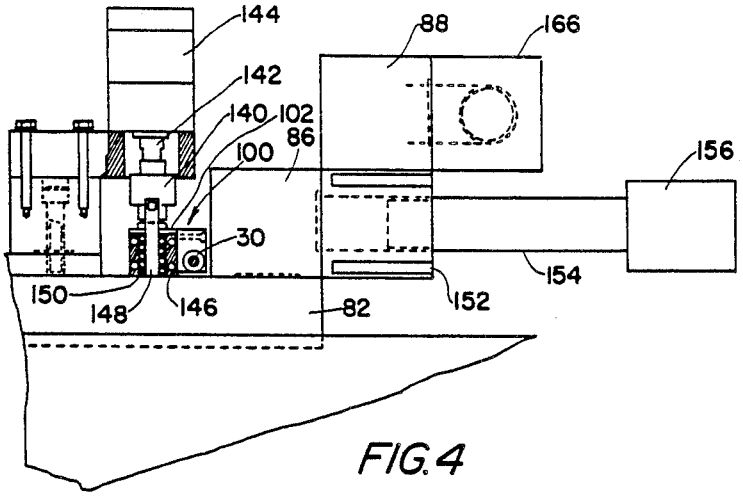
FIG. 4 is a fragmentary longitudinal elevational view of the apparatus illustrated in FIG. 2 with portions thereof illustrated in cross section.
Figure 5:
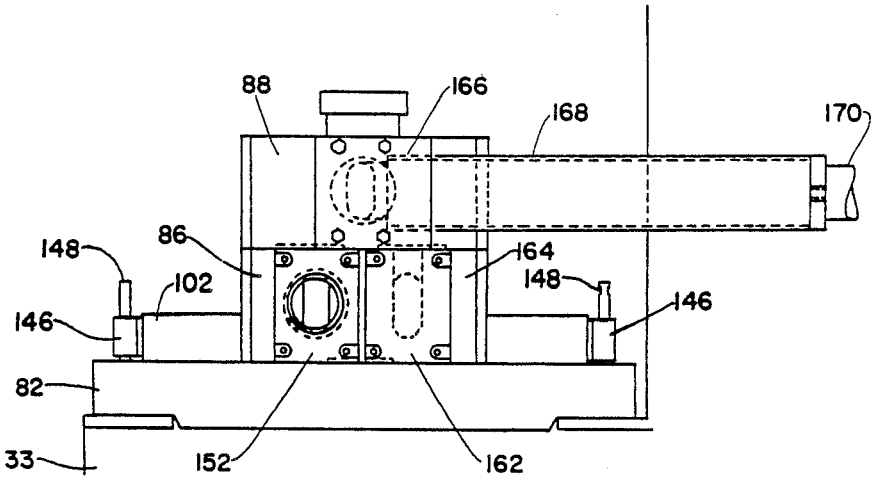
FIG. 5 is an end elevational view of the apparatus illustrated in FIG. 4 with portions thereof removed for clarity.

The bar 102 of the air lock 100, as best illustrated in FIGS. 4 and 5, is fastened to a coupling 140 which in turn is connected to the end of a piston rod 142 of an air cylinder 144 which during each index cycle drives the bar 102 as hereinafter described. Fastened at each end of the bar 102 is a small housing 146 within which a plunger 148 is resiliently mounted by means of a coil spring 150 disposed within the housing 146. The plunger 148 is biased so as to oppose the action of the piston rod 142 during each extension stroke when the bar 102 seals the channel 94 and clamps the lidding material, and acts rapidly to return the bar 102 away from the channel 94 to permit the lidding material to be fed when the pressurized air valved to the cylinder 144 is vented. Each time the piston is driven downwardly, the channel 94 is shut in sealed fashion to prevent escape of gas or loss of the vacuum.

The solenoid valve 86 is preferably a three-way valve connected through a manifold 152 to a conduit 154 which communicates with a vacuum applying source such as a vacuum pump 156. Additionally the valve 86 communicates through a conduit 155 with a port 157 which extends through the plates 110, 112 and 116 and opens into the cavity 122 remote from the port 84. Preferably the same vacuum source may communicate with another three-way solenoid valve 158 which is connected to the bottom port 38 of the manifold plate 34 by means of a conduit 160. Both valves 86 and 158 may be actuated to move between a position wherein the vacuum pump communicates with the ports 84, 157 and 38 respectively or may shut such communication and vent the respective port to atmospheric pressure, the valve 58 venting to atmosphere and the valve 86 venting through a vent manifold 162 to gas from the previous purge cycle. The valves 86 and 158, of course are individually actuated selectively. Thus, the top and bottom of the packages in the cavity 122 may be placed under subatmospheric pressure or under atmospheric pressure selectively. Additionally, the valve 86 may act acts in conjunction with a two-way solenoid valve 164 connected in the vent line between the valve vent port which of course is the gas inlet side of the three-way valve 86, and the vent manifold 162 so that when venting the valve 164 may be closed after the vacuum has been released. The solenoid valve 88 is mounted adjacent the valve 86 and is connected through a manifold 166 to a plenum chamber 168 which receives an inert gas such as nitrogen or preferably a combination of nitrogen and carbon dioxide in a ratio of approximately 75 percent to 25 percent, the gas being supplied to the plenum 168 through a conduit 170 from a gas source (not illustrated). The valve 88 may be a two-way valve acting between an open position receiving gas from the plenum 168 and a closed or blocking position wherein the gas is supplied to but held in the plenum chamber for the next cycle.

The valve 86 communicates with the port 84 in the heater mounting plate so that it may communicate the port 84 and thus the cavity 122 to either the vacuum source 156, or to the gas valve 88 which communicates with the port 84 when the valve 88 it is open to apply gas to the port 84. When the gas valve is open, the vent valve 164 is closed so that the gas is supplied to the port 84 enters the cavity 122.

Figure 6:
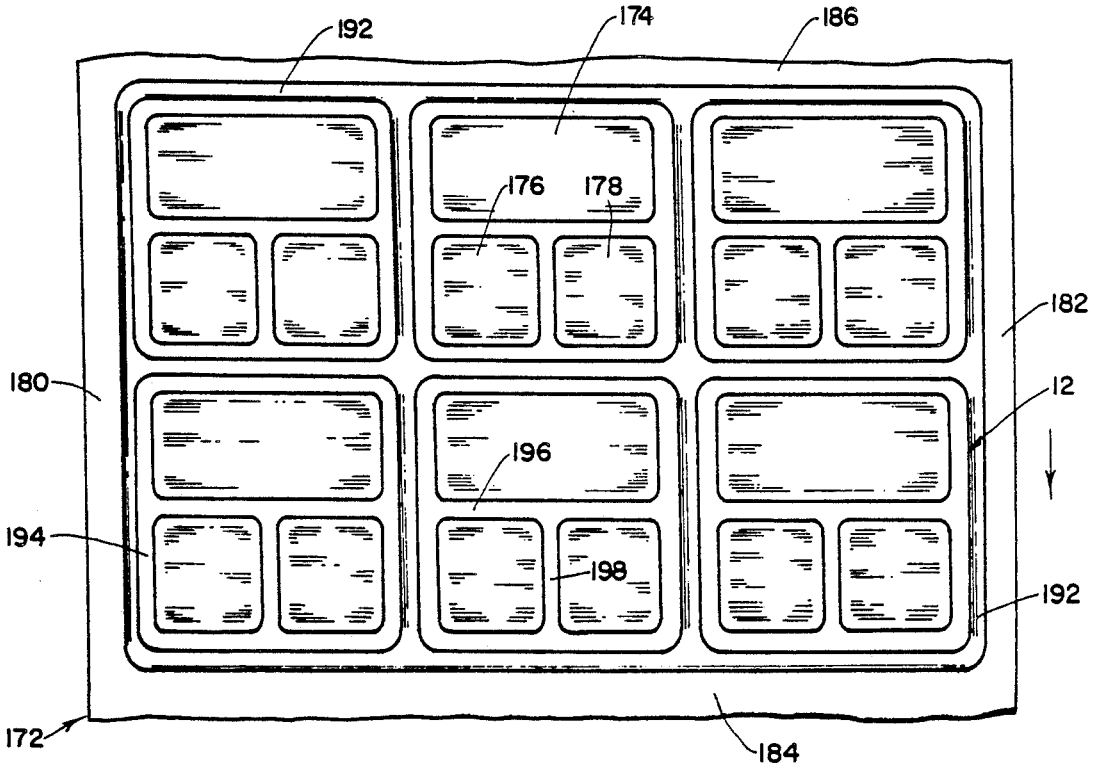
FIG. 6 is a top plan view of a group of bases acted upon by the apparatus and method of the present invention prior to the insertion of product therein and the application of lidding material thereto.

Illustrated in FIG. 6, is a group 172 of six bases 12, each base in the preferred embodiment preferably comprising three food receiving cavities 174, 176, 178, which for example may receive crackers, meat and cheese respectively. The bases in each group are formed from the forming material 14 and are transported through the machine in the direction illustrated by the arrow, each group having a pair of longitudinally extending selvage or edge portions 180, 182 and connected to the preceding and succeeding groups by small web leading and trailing end portions 184, 186 respectively. The edge portions 180, 182 are grasped by transporter clamping members 188, 190 of a conventional conveyer (not illustrated) for feeding the bases and subsequently sealed packages through the machine.

Formed about each individual base is a peripheral groove 192 recessed relative to the top surface of the bases as best illustrated in FIGS. 2 and 3. The grooves 192 aid in permitting a vacuum to be drawn and gas to be applied to the group of packages in the die 124 in the sealing station of the machine while the lidding material is disposed on the bases and prior to the bonding of the lidding material to the bases, the lidding material being bonded to the upper surface of the bases about the entire periphery 194 of each package and preferably to the surface 186 between the cavity 174 and the cavities 176, 178. Additionally, the lidding material may be bonded to the surface 198 intermediate the cavities 176 and 178 utilizing an additional rib 126 and forming head in the inserts for this purpose.

It may now be understood that the utilization of one sealing piston 130 for each die 124 and thus for each package provides individual control of the bonding of the lidding material 26 to the bases of the packages which minimizes waste should the bonding of one package be defective. For example, should the upper surface of a particular package have a defect or blemish such as a bump that would hold the lidding material above the surface adjacent the bump resulting in a poor seal, this would not affect the other packages of the groups, as would be in the case of the prior art where only a single piston is utilized for the entire group. Additionally, the package that has the blemish may also be successfully sealed without being rejected since an individual piston for each package appears to permit the package to give or rebound to compensate somewhat about the blemish.

In the operation of the apparatus and method of the present invention, assuming that an index of the machine has occurred and a first group of unsealed packages has been transported into the sealing section beneath the sealing plate 120 and a second group of bases attached to the first group has been transported to the entry section beneath the film shoe 108 and the port 84, the piston rods 66 are then extended to raise the rails 44, 46, the manifold plate 34, the evacuation chamber 32 and the die inserts 124 upwardly, and the air lock piston 142 is extended to shut the channel 94 by means of the air lock bar 102.

The valve 158 is then actuated to draw a vacuum through the port 38 and the valve 88 is actuated to apply a purging gas through the port 84. Thus, the bottom of each base 12 in the entry and sealing sections has subatmospheric pressure applied thereto while the positive gas pressure is applied at the top. The gas applies an initial purging to the cavities diluting the oxygen level and also pushes the bases downwardly in the evacuation chamber to positively position the bases. Thereafter the valve 88 is shut and the valve 86 is actuated to draw a vacuum through the ports 84 and 157. Most of the remaining air, gas and impurities are drawn from the cavities of the second group of bases in the entry section while gas and remaining impurities are drawn from the interior of the first group of bases in the sealing section, the first group having lidding material 26 laid thereon so that gas may flow between the lidding material and the bases as aided by the grooves 192 about the package cavities 174, 176, 178. The valve 86 is thereafter actuated to the vent position and the valve 88 is opened thereby releasing the vacuum at the top of the cavity above the bases and applying gas through the open vent of valve 86. The conduit 155, however, holds a slight negative pressure by the action of a check valve 200 in the conduit so that the lidding material is prevented from being forced onto the bases in the sealing section. When the valve 86 is in the vent position and the gas valve 88 is actuated to communicate gas from the plenum chamber 168 to the port 84, the gas is applied readily to the cavities of the bases in the entry section and to the top of each base 12 between the lidding material and the bases and including the groove 192 into the cavities 174, 176, 178 of the bases in the sealing section. The check valve 200 prevents the gas from entering the port 157 which holds the slight negative pressure and ensures that the gas can flow between the lidding material and the bases. The bases act as a gas barrier so that the gas is contained in the top portion of the cavity 122 and a positive gas pressure can be maintained in the package cavities. The valve 88 is then actuated to shut the flow of gas therethrough and a slight dwell period is thereafter provided to permit the gas to be distributed evenly within the package cavities.

Pressurized air is thereafter applied through the valve 138 to the manifold 136 and the conduits 134 to drive the pistons 130 upwardly so that the sealing dies force the bases and lidding material against the hot sealing plate 120 to bond the bases and lidding material together about at least the periphery 194 and the surface 196 of each package. The three-way valve 158 is then actuated to the vent position to release the vacuum in the lower portion of the cavity 122 after which time the air lock piston 142 is retracted to release the bar 102 from its sealing relationship with the channel 94. The pressure in the top and bottom of the cavity 122 are then equalized since they are both at atmospheric pressure. The pressure on the piston 68 may then be vented to drive the manifold plate 34, the evacuation chamber 32 and the dies 124 downwardly to open the cavity 122. The machine is then indexed to feed the first group of packages out of the cavity 122 for separating the packages from the group and for further processing, while the second group of bases is fed to the sealing section and another group of bases is fed to the entry section of the cavity 122. The feeding of the bases is accompanied by a feeding of the lidding material 26 so that the lidding material is disposed over the entire top of the second group of bases and a portion of the group that is received in the entry section. Since carbon dioxide is heavier than air, a portion of the gas remains in the cavities as each group is indexed to the sealing section even though the air lock is open.

The aforesaid process is thereafter repeated so that the process is continuous and each package leaving the machine is gassed twice in the same time interval that a single gassing occurs in the prior art. The initial gas purge prior to the vacuum drawing step reduces the vacuuming time required by reducing the oxygen level The process not only results in less impurities in the sealed package for the same processing time, but it has been found that additional deareation of package meats occurs which results in increased shelf life. Additionally, because the gassing step permits a positive gas pressure to be sealed into the packages with a slight bellowing of the lidding material, it may readily be determined when a package is properly sealed or whether leakage has occurred due to an improper seal merely by noting whether the lidding material remains in the bellowed disposition.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of forming hermetically sealed food containing packages having a base including at least one food containing cavity open at the top thereof and having a peripheral web including an upper surface disposed about the top of said cavity, said method comprising feeding to a first station of a chamber a group of bases interconnected at adjacent peripheral webs forming a gas barrier preventing leakage between the exterior of said bases beneath said webs and each cavity, closing said chamber to isolate said exterior of said bases beneath said webs from each cavity, communicating a subatmospheric pressure to the exterior of said bases beneath said web, applying an inert gas into each cavity to flush said cavities, thereafter communicating a subatmospheric pressure to each cavity to remove a substantial amount of the gas together with air and impurities from each cavity, again applying an inert gas to each cavity, releasing the subatmospheric pressure at the exterior of said bases beneath said webs, equalizing the pressure in said cavities with the pressure at the exterior of said bases beneath said webs, opening said chamber, laying a lidding material over the upper surfaces of said webs and transporting said bases to a second station of said chamber, closing said chamber to isolate said exterior of said bases beneath said webs from each cavity, communicating a subatmospheric pressure to the exterior of said bases beneath said webs, applying an inert gas into each cavity between said lidding material and said upper surface of said webs to flush said cavities, thereafter communicating a subatmospheric pressure to each cavity to remove a substantial amount of gas together with a substantial amount of the remaining air and impurities from each cavity, again applying an inert gas into each cavity between said lidding material and said upper surfaces, bonding said lidding material to said upper surfaces about said cavities to seal said cavities, releasing the subatmospheric pressure at the exterior of said bases beneath said webs, equalizing the pressure above said upper surface with the pressure at the exterior of said bases beneath said webs, and opening said chamber to remove said bases.

2. In the method as recited in claim 1, wherein said laying of lidding material over said surfaces of said bases occurs while transporting said bases to said second station.

3. In the method as recited in claim 1, wherein said group of bases includes grooves formed in and recessed beneath said upper surfaces extending peripherally about each base in said group and at least a portion of said subatmospheric pressure and inert gas is applied through said grooves while said bases are at said second station.

4. In the method as recited in claim 1, wherein said inert gas comprises a mixture of nitrogen and carbon dioxide and said bases when transported to said second station are exposed to atmospheric pressure.

5. In the method as recited in claim 1, wherein said bonding comprises independently bonding each base of said group to lidding material disposed thereon substantially simultaneously with the bonding of lidding material to the other bases of said group.

6. In the method of forming hermetically sealed food containing packages comprising feeding groups of food containing bases having at least one food containing cavity open at the top of each base to a sealing station for bonding lidding material to the tops of said bases to seal the bases, the improvement comprising feeding to a first gassing station a first group of bases interconnected at upper peripheral surfaces forming a gas barrier preventing leakage between the exterior of said bases beneath said surfaces of each cavity, applying a subatmospheric pressure to the exterior of said bases beneath said surfaces, applying an inert gas above said surfaces into each cavity, thereafter communicating a subatmospheric pressure to each cavity, shutting said communication of subatmospheric pressure with each said cavity, again applying an inert gas to each said cavity to flush each cavity, releasing the subatmospheric pressure at the exterior of said bases beneath said surfaces, laying a lidding material over the first group of bases, feeding said first group of bases to said sealing station and feeding a second group of interconnected bases identical to the first group of bases and interconnected to said first group to said first gassing station, applying a subatmospheric pressure to the exterior of the first and second group of bases beneath said surfaces, applying an inert gas above said surfaces into each cavity of both said groups, thereafter communicating a subatmospheric pressure into each cavity of both said groups, shutting the communication of subatmospheric pressure to the cavities of said first and second group, again applying inert gas to the cavities of both said first and second groups, and bonding said lidding material to the tops of the bases of said first group about each cavity therein to seal each said cavity with gas therein.

7. In the method as recited in claim 6, wherein said lidding material is laid over the top of a leading edge portion of said first group in said first gassing station, and said lidding material is laid over the remainder of said first group while said first group is fed to said sealing station.

8. In the method as recited in claim 6, wherein said first and second groups are interconnected together at marginal portions of upper surfaces of said bases and each group includes grooves formed in and recessed beneath said upper surfaces, and at least a portion of said subatmospheric pressure and inert gas is applied through said grooves while said first group of bases is at said sealing station.

9. In the method as recited in claim 6, wherein said inert gas comprises a mixture of nitrogen and carbon dioxide and said bases when transported to said sealing station are exposed to atmospheric pressure.

10. In the method as recited in claim 6, wherein said bonding comprises independently bonding each base of said first group to lidding material disposed thereon substantially simultaneously with the bonding of lidding material to the other bases of said first group.

* * * * *